United States Patent [19]

Saegusa

[11] Patent Number: 4,504,202

[45] Date of Patent: Mar. 12, 1985

[54] SINTERED ROTOR FOR A ROTARY PUMP AND A MANUFACTURING METHOD FOR THE ROTOR

[75] Inventor: Yasuyoshi Saegusa, Hyogo, Japan

[73] Assignee: Sumitomo Electric Industries, Ltd., Osaka, Japan

[21] Appl. No.: 448,503

[22] Filed: Dec. 9, 1982

[30] Foreign Application Priority Data

Jul. 23, 1982 [JP] Japan ..... 57-129448

[51] Int. Cl.[3] ..... F04C 2/10; B22F 5/08

[52] U.S. Cl. ..... 418/150; 418/171; 29/156.4 R

[58] Field of Search ..... 418/150, 166, 171; 29/156.4 R; 264/56, 67

[56] References Cited

U.S. PATENT DOCUMENTS 2,965,039 12/1960 Morita ..... 418/150

FOREIGN PATENT DOCUMENTS 20406 of 1929 Australia ..... 418/166

55-148991 11/1980 Japan ..... 418/171

55-148992 11/1980 Japan ..... 418/171

*Primary Examiner*—John J. Vrablik

*Attorney, Agent, or Firm*—Wenderoth, Lind & Ponack

[57] ABSTRACT

A sintered outer rotor for a rotary pump utilizing the trochoidal curve and a manufacturing method for the rotor, the rotor being formed to make a combinational gap between an inner rotor and the outer rotor as small and constant as possible in order that both the inner and outer rotors are rotatable. The rotor is formed with an eccentricity ratio less than a limit based upon an experimentally obtained function of the ratio of the diameter of the base circle to that of the rolling circle used to form the trochoidal curve, and with corrected circular arcs of the tooth portions such that $|\Delta b|+|\Delta c|<0.3$ mm and $\Delta b>\Delta c$, wherein $\Delta b$ and $\Delta c$ are respectively the corrections to the centers of the circular arcs and the radii of the circular arcs. The ratio of the base circle to that of the rolling circle is not an integer and therefore is not equal to the number of outer rotor teeth as in the conventional outer rotor.

2 Claims, 9 Drawing Figures

SINTERED ROTOR FOR A ROTARY PUMP AND A MANUFACTURING METHOD FOR THE ROTOR

BACKGROUND OF THE INVENTION

This invention relates to a sintered rotor for a rotary pump and a manufacturing method for the rotor.

An inner rotor for a rotary pump utilizing the trochoidal curve, when given a diameter A of a base circle, a diameter B of a rolling circle, an eccentricity e, and a diameter C of a locus circle (tracking circle), can obtain an inner rotor curve TC as the envelope of a circular-arc group centered on the trochoidal curve T, and also a theoretical curve of an outer rotor is obtained.

In this case, a combinational gap g between the inner and outer rotors from the above dimensions, that is the gap formed on the opposite side from where the inner and outer rotors touch, is zero so that both the rotors are not rotatable. Hence, in fact, the curve of the inner rotor is corrected to be smaller, or that of the outer rotor is corrected to be larger, thereby producing the combinational gap g through which the rotors become rotatable.

The gap g as a function of the rotational position (rotary angle) of the inner rotor relative to the outer rotor before and after the correction is shown respectively by the dotted and solid curves in FIG. 2.

Such correction for the curves at present is carried out experimentally so that the combinational gap g of each part in a commercial rotary pump utilizing the trochoidal curve is not constant but rather fluctuates with changes in rotary angle $\theta$, in which the regulation S is given by the equation:

$$S = \frac{g\ \text{max.} - g\ \text{min.}}{g\ \text{max.}}$$

where g max and g min are respectively the maximum value and minimum value of the combinational gap g over a complete revolution of the inner rotor within the outer rotor. The regulation S of the rotors which have the combinational gap g prior to correction as shown by the dotted line in FIG. 2, is about 60~80%, which is made smaller by the correction shown by the solid line in FIG. 2. In other words, the combinational gap at each part is made about constant and smaller by the correction, thereby enabling an improvement in the performance of the pump.

However, when the maximum combinational gap g max. is made smaller, the minimum combinational gap g min. portion causes interference with teeth which leads to poor rotation of the pump, whereby the combinational gap is restricted in its diminution.

For diminishing the gap regulation the following methods are proposed:

(a) To select a smaller eccentricity ratio $f_e=(e/B)$ for the inner rotor.

(b) To properly correct the theoretical curve of the outer rotor.

(c) To reasonably combine the above methods (a) and (b).

In addition, if the correction by the method (b) is made properly, even if the eccentricity ratio of the inner rotor is not reduced in accordance with the method (a), the regulation S can be made smaller to a certain, but limited, extent.

Conversely, even if the eccentricity ratio of the inner core is reduced in accordance with the method (a), the correction of the curve of outer rotor, if not proper, cannot diminish the regulation S.

This inventor has filed a Japanese Patent Application (disclosure No. 148992 (1980)) for the rotor of a rotary pump of the curve formed by combining the methods (a) and (b) to have a regulation S of 60% or less and has also filed a Japanese Patent Application (application disclosure No. 148991 (1980)) directed to the correction for the theoretical curve of the outer rotor.

The inventor, after conducting research since then, has found out that, in the case where the number of teeth of the inner rotor in the Japanese Patent Application disclosure No. 148992 (1980) is the integer n, not only the eccentricity ratio $f_e$ but also a ratio A/B between the base circle diameter A and the rolling circle diameter B are determined according to the integer n, whereby the method of correcting the curve can correspond not only to the number of teeth of the integers n=1, 2, 3 . . . , but also to the special tooth form wherein the number of teeth includes those represented in the hatched area in FIG. 3, in which n=4.5, n=5.5 . . . are shown. Furthermore, the inventor has found out that, when this method is applied to the design of a metallic mold used for manufacturing the sintered rotor so that the metallic mold is used to produce the sintered rotor, a desired sintered rotor can be produced. As a result, the inventor has designed this invention.

BRIEF DESCRIPTION OF THE DRAWINGS

The invention will hereinunder be described in detail with reference to the accompanying drawings, wherein.

OBJECT AND SUMMARY OF THE INVENTION

An object of the invention is to provide a sintered outer-rotor for a rotary pump utilizing the trochoidal curve and a manufacturing method for the rotor, characterized in that the rotor has the curve form satisfying the following conditions for the purpose of making the combinational gap between the inner rotor and the outer rotor about constant throughout the overall circumference, that is, (1) the trochoid dimensions are so selected that when among them the base circle diameter is represented by A mm, the rolling circle diameter by B mm, the eccentricity by e mm, the eccentricity ratio by $f_e=(e/B)$, and a ratio A to B by n, the following inequality and equation are satisfied:

$$0 < fe \leqq fe(n)$$

$$fe(n) = a_0 + \frac{a_1}{n} + \frac{a_2}{n^2} + \frac{a_3}{n^3} + \frac{a_4}{n^4},$$

where $a_0$, $a_1$, $a_2$, $a_3$, and $a_4$ are experimentally determined constants for maintaining the variation of the clearance small, such as $a_0=0.5$, $a_1=1.434$, $a_2=-19.79$, $a_3=51.02$ and $a_4=-33.11$ respectively, and (2) when a correction to the value of a distance b between the center of a circular arc defining the theoretical profile of each tooth of the outer rotor based on the trochoidal curve and the center of the outer rotor, is represented by $\Delta b$ mm, and a correction of a radius $C_1$ of said circular arc is represented by $\Delta c$ mm, the value of $\Delta b$ and $\Delta c$ satisfying the following inequality are selected to correct the outer rotor's curve:

$$|\Delta b| + |\Delta c| < 0.3 \text{ mm},$$

where $\Delta b > \Delta c$.

DETAILED DESCRIPTION OF THE PREFERRED EMBODIMENT

Figure 1:
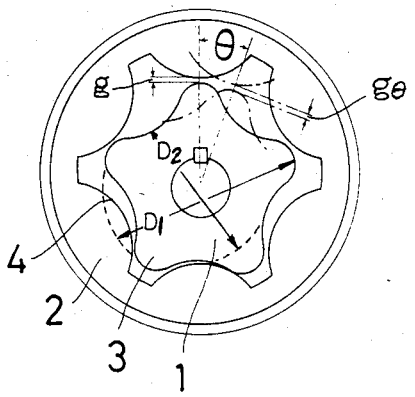
FIG. 1 is a view explanatory of a combinational gap between an inner rotor and an outer rotor utilizing the trochoidal curve.

FIG. 1 shows a relation between an inner rotor 1 and an outer rotor 2, in which a gap g, formed when a top surface of a tooth 3 of the inner rotor 1 is opposite to a top surface of a tooth 4 of the outer rotor 2, is shown by the solid line, and a gap $g\theta$, formed when the inner rotor 1 rotates by a rotary angle $\theta$, is shown by the dot-and-dash line, where $g \neq g\theta$.

In the present invention, the first condition for meeting the objective of keeping the combination gap g about constant is based upon having an eccentricity ratio $f_e$ which depends upon the theoretical computations which have been made and affirmed in the actual products, that the eccentricity ratio with respect to the value of n should be given by $$0 < fe \leqq fe(n)$$

$$fe(n) = a_0 + \frac{a_1}{n} + \frac{a_2}{n^2} + \frac{a_3}{n^3} + \frac{a_4}{n^4}$$

where $a_0$, $a_1$, $a_2$, $a_3$ and $a_4$ are the constants as $a_0=0.5$, $a_1=1.434$, $a_2=-19.79$, $a_3=51.02$ and $a_4=-33.11$ respectively. The above equation for $f_e(n)$ is shown in FIG. 3.

Figure 3:
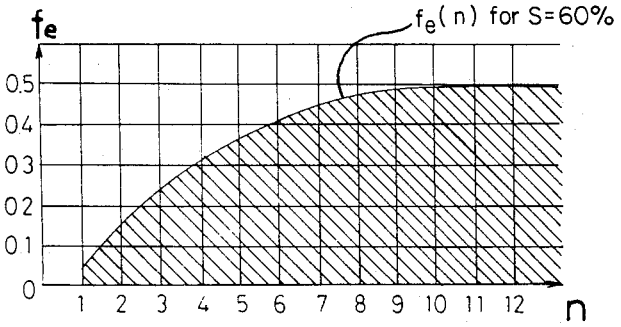
FIG. 3 is a view showing the relation between n and $f_e$.

Concretely, when the eccentricity ratio $f_e$ for the outer rotor is selected within a range of the hatched area in FIG. 3 showing the relation between $f_e$ and n, the gap regulation S can be kept in the range 0 to 60%, the range of permissible eccentricity ratio $f_e$ being widened as n increases and the gap regulation S decreasing as $f_e$ decreases.

For example, (a) when n=4.5, while S=70% at the eccentricity ratio $f_e=0.4$, the regulation S can be diminished to 45% at $f_e=0.3$ and to 20% at $f_e=0.2$, (b) when n=6, while the regulation S is 60% at $f_e=0.4$, S can be diminished to 25% at $f_e=0.3$ and to 57% at $f_e=0.2$, and (c) when n=10, while the regulation S is 60% at $f_e=0.49$, S can be diminished to 25% at $f_e=0.4$, 11% at $f_e=0.3$, 5% at $f_e=0.2$, and 2% at $f_e=0.1$.

As seen from the above, the above values correspond to the minimum value in the range 60 to 80% or a limit value less than that, of the combinational gap regulation of a commercial oil pump rotor, so that a value $f_e$ in a range less than the above value is selected to diminish the value S and combinational gap g, thereby remarkably improving the performance of the pump, especially the volumetric efficiency under high pressure.

Figure 4:
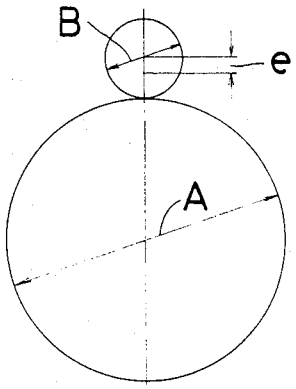
FIGS. 4 and 5 are views explanatory of the dimensions in the design of a rotor utilizing the trochoidal curve.
Figure 2:
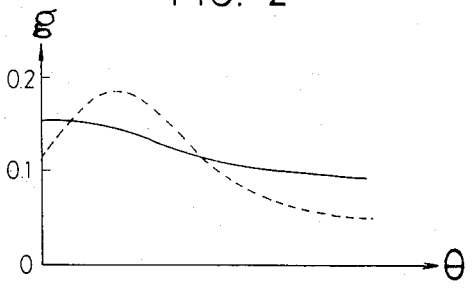
FIG. 2 shows curves of change in combinational gap between the inner and outer rotors.
Figure 5:
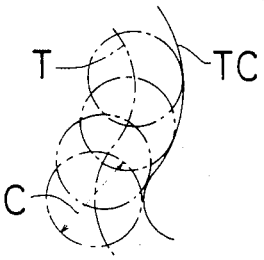

In addition, FIGS. 4 and 5 illustrate the dimensions in the design of the rotor utilizing the trochoidal curve wherein in FIG. 5 C is the diameter of the well known tracking circle whose locus when moved along with the trochoidal curve T at its center traces a theoretical inner surface (profile) for an outer rotor and is equal to twice the radius of the circular arc of each of the tooth portions of said theoretical inner surface.

To form the trochoidal curve T, a rolling circle of diameter B is rotated on a base circle of diameter A and a point a distance equal to the eccentricity e from the center of the rolling circle traces a trochoidal curve. It is well known that if the ratio A/B is a integer the curve TC will form a closed curve after only one revolution of the rolling circle about the base circle. However, if the ratio A/B is not an integer, two or more revolutions will be needed before the trochoidal curve is closed. For example, if $A/B=X+(Y/Z)$ where X, Y and Z are integers, Z greater than Y, the number of required revolutions is given by the smallest integer K such that $K\cdot(Y/Z)$ is an integer. The number of inner rotor teeth as defined by this structure is $N\cdot K\cdot A/B$.

Figure 7:
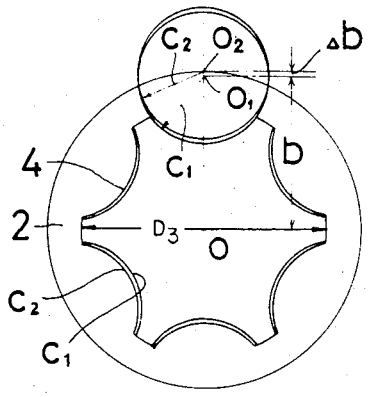
FIG. 7 is a view explanatory of the correction elements for the curve of the outer rotor in accordance with the invention.

Referring to FIGS. 1, 4 and 5, it is well known that the outer diameter $D_1$ of an inner rotor formed from the trochoidal curve is given by $D_1=A+B-C+2e$ and that the inner diameter $D_2$ thereof is given by $D_2=A+B-C-2e$. Referring to FIG. 7, the formation of the inner surface of the outer rotor is well known to be defined by N spaced circular arcs of radius $c_1$, $c_1$ being given by $c_1=C/2$, radius $c_1$ centered at N equally spaced points on the circumference of an outer circle (circular arc) of radius b given by $b=(A+B)/2$. The arcs terminate on segments of a circle of diameter $D_3$ given by $D_3 \geqq A+B-C+4e$.

Figure 6:
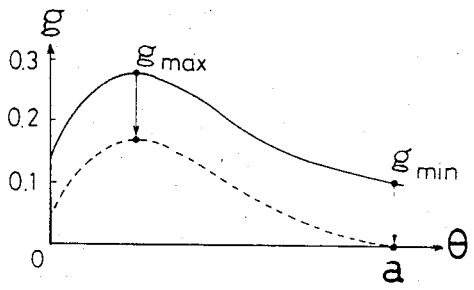
FIG. 6 PRIOR ART
FIG. 6 shows curves of the gap regulation for an exemplary oil pump rotor.

Next, the second condition for keeping the combinational gap g about constant will be described referring to FIG. 7 showing the correction elements for the curve of the outer rotor. The correction is made by first increasing b by $\Delta b$ ($\overline{OO_2}-\overline{OO_1}$) and then reducing $c_1$ by $\Delta c$ to $c_2$. Conventional correction of these radii is about $\Delta b=+0.02$ to 0.4 mm (symbol + designating enlargement of distance between the centers) and $\Delta c=+0.1$ to 0.3 mm ("+" designating enlargement of the radius). Referring to FIG. 6, when the rotary angle $\theta$ of inner rotor 1 of a commercial pump is measured along the abscissa axis and the gap g is measured along the coordinate axis, the curve becomes as shown in FIG. 6, in which, if the maximum gap g max. is diminished as shown by the dotted line, at the point a of g min., interference between the inner and outer teeth occurs. Therefore, the amount by which the maximum gap g max can be reduced is restricted.

Figure 8:
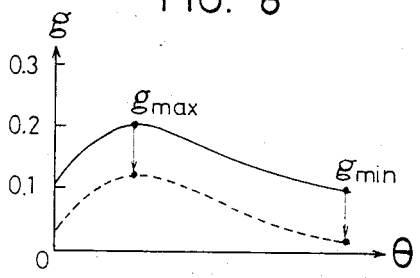
FIG. 8 shows the curve of the gap regulation after the curve of the outer rotor is corrected.

This invention is characterized in that as a result of analysis involving confirming the corrected values from the theoretical profile of the outer rotor based on the trochoidal curve and an actual product of the combinational gap, the combinational gap regulation S and g max. and g min., when given the trochoid dimensions, the corrected values each become a function of the correction $\Delta b$ of the distance b between the centers of circular arcs and of the correction $\Delta c$ that of the radius $C_1$ of the circular arc, as given by g max. $=f_1(\Delta b, \Delta c)$, g min. $=f_2(\Delta b, \Delta c)$, and $S=f_3(\Delta b, \Delta c)$, It has been determined from this analysis that if the corrected values $\Delta b$ and $\Delta c$ are selected to keep the sum of absolute values of $\Delta b$ and $\Delta c$ less than 0.3 mm, the gap regulation S becomes smaller than that of the conventional commercial pump (under 60%) and the undulation at the curve of the gap variation becomes smooth when the outer rotor's curve is corrected as shown in the gap regulation curve in FIG. 8, resulting in proper pump rotation.

In this case, however, the combinational gap g becomes negative unless $\Delta b$ and $\Delta c$ have a relation therebetween of $\Delta b-\Delta c>0$.

For example, in the conventional mass-produced oil pump with an outer rotor having an outer diameter of 40 mm, with $\Delta b=0.3$ mm and $\Delta c=0.25$ mm, then $|\Delta b|+|\Delta c|=0.55$ mm and g max. of $108\mu$ and g min. of $32\mu$ are obtained resulting in a gap regulation S of 70%, while, if in accordance with the invention $\Delta b=0.15$ mm and $\Delta c=0.1$ mm, then $|\Delta b|+|\Delta c|=0.25$ mm and g max. of $123\mu$ and g min. of $67\mu$ are obtained to get S=46%. Thus, in a range of $$|\Delta b|+|\Delta c|<0.3 \text{ mm}$$

(where $\Delta b>\Delta c$), the minimum value of gap regulation to the outer rotor's curve is obtained, thus making it possible to similarly obtain the minimum value of gap regulation regarding various types of the rotor.

Figure 9:
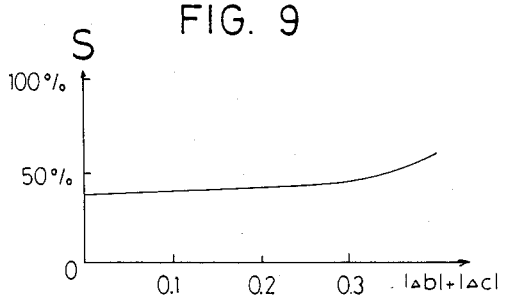
FIG. 9 shows the curve of the relation between a corrected value ($|\Delta b|+|\Delta c|$)and the gap regulation.

In FIG. 9, the above corrected value $|\Delta b|+|\Delta c|$ is measured along the abscissa axis and the gap regulation S is measured along the coordinate axis and the curve shows the relation between $|\Delta b|+|\Delta c|$ and S. As seen from the curve, the gap regulation is diminished and the maximum combinational gap g max. is made smaller to nearly equalize the gaps between the respective parts, thereby improving the performance of pump, especially, the volumetric efficiency under high pressure.

The present invention is particularly characterized by representing by n not the number of teeth at the inner rotor but the ratio, i.e., A/B, of the base circle diameter A to the rolling circle diameter B, so that various tooth forms can be obtained based on the trochoidal curve within the range of the hatched portion in FIG. 3 with A/B not being an integer (e.g. n=4.5).

The rotor of the invention may be produced by a machining process, but it is rather effective in reducing the manufacturing cost and improving performance to mass-produce the sintered rotors with a noticable feature of using a metallic mold.

The present invention also is applicable to a technical design for the metallic mold used for manufacturing the rotor.

Explanation will now be given of the application of the invention to the technical design of the metallic mold.

Conventionally, the metallic mold utilizing the trochoidal curve has been designed and produced in such a manner that a template is made to conform with a handmade enlarged drawing of the curve and then the metallic mold is machined by use of the template, but it has been very difficult to maintain the accuracy of sintered parts which tend to cause a change in dimension during the sintering process, especially to the tooth form, after the sintering process. Hence, usually, the product has has applied thereto a repress work (sizing) for tooth reforming. In case the product does not conform with a desired accuracy, the remedy therefor is to partially correct the handmade enlarged drawing. Such method in a trial and error manner, however, not only takes much time and expense to get a desired tooth form, but also makes the dimensions of the produced metallic mold impossible to exactly express for purposes of design.

On the contrary, the present invention and a computing system for attaining the purpose thereof are applied to make it possible to design a metallic mold for molding and sizing to meet with variation of the size and the dimensions of the desired form for the product during the process of sintering of powdery material.

In other words, after designing the product of a desired form under the dimensions, in view of the rate of change in dimension during the sintering process and a proper allowance for the reforming during the sizing process, the design dimensions for the metallic mold are redetermined by the same method and then the mold of said dimensions is produced by a metallic mold machining machine, e.g., a wire cut machine. Such method provides the possibility of saving the sizing process conventionally necessary and also can provide a rotor of sintered parts which is inexpensive and of high quality.

What is claimed is:

1. A rotary pump comprising:

a. an inner rotor having an outer surface defined by the curve generated by the locus of the periphery of a tracking circle of diameter C centered on a closed trochoidal curve when the tracking circle is moved along the closed path defined by the entire trochoidal curve, the trochoidal curve being generated by the locus of a point a distance e from the center of a rolling circle of diameter B when the rolling circle is rolled on the outside of a base circle of diameter A around the base circle a sufficient number of times that the locus intersects the position of the point where rolling of the rolling circle is initiated, wherein the ratio n given by n=A/B is a non-integer, said outer surface defining a number N of inner rotor teeth equal to a multiple K of n such that K·n is an integer, the magnitudes of e, A, B and n being such that if the eccentricity ratio is represented by $f_e=e/B$, then $f_e$ satisfies the following inequality:

$$0<f_e<f_e(n),$$

where $$f_e(n)=a_0+a_1/n+a_2/n^2+a_3/n^3+a_4/n^4,$$

where $a_0=0.5$, $a_1=1.434$, $a_2=-19.79$, $a_3=51.02$ and $a_4=-33.11$; and b. an outer rotor having an inner surface engaging the outer surface of the inner rotor, said outer surface having more than N circular arc-shaped tooth portion defined by more than N spaced circular arcs of radius c, c being given by $c=C/2-\Delta c$, inside of and centered on the circumference of a circle of radius b, b being given by $b=(A+B)/2+\Delta b$, where $|\Delta b|+|\Delta c|<0.3$ mm, and $\Delta b>\Delta c$, whereby a combinational gap between the inner rotor and the outer rotor can be maintained generally constant throughout the overall circumference of each of the inner and outer rotors as the inner rotor is eccentrically rotated in the outer rotor.

2. A method of manufacturing a rotary pump having an inner rotory eccentrically rotatable in an outer rotor, the method including the steps of:

a. molding and/or sizing the inner rotor in a metallic mold having such dimensions that the inner rotor has an outer surface defined by the curve generated by the locus of the periphery of a tracking circle of diameter C centered on a closed trochoidal curve when the tracking circle is moved along the closed path defined by the entire trochoidal curve, the trochoidal curve being generated by the locus of a point a distance e from the center of a rolling circle of diameter B when the rolling circle is rolled on the outside of a base circle of diameter A around the base circle a sufficient number of times that the locus intersects the position of the point where rolling of the rolling circle is initiated, wherein the ratio n given by $n=A/B$ is a non-integer, said outer surface defining a number N of inner rotor teeth equal to a multiple K of n such that $K \cdot n$ is an integer, the magnitudes of e, A, B and n being such that if the eccentricity ratio is represented by $f_e=e/B$, then $f_e$ satisfies the following inequality:

$$0<f_e \leqq f_e(n),$$

where $$f_e(n)=a_0+a_1/n+a_2/n^2+a_3/n^3+a_4/n^4,$$

where $a_0=0.5$, $a_1=1.434$, $a_2=-19.79$, $a_3=51.02$ and $a_4=-33.11$; and b. molding and/or sizing the outer rotor in a metallic mold having such dimensions that the outer rotor has an inner surface which is engagable with the outer surface of the inner rotor, said outer surface having more than N circular arc-shaped tooth portions defined by more than N spaced circular arcs of radius c, c being given by $c=C/2-\Delta c$, inside of and centered on the circumference of a circle of radius b, b being given by $b=(A+B)/2+\Delta b$, where:

$$|\Delta b|+|\Delta c|<0.3 \text{ mm, and}$$

$$\Delta b>\Delta c,$$

whereby a combinational gap between the inner rotor and the outer rotor can be maintained generally constant throughout the overall circumference of each of the inner and outer rotors as the inner rotor is eccentrically rotated in the outer rotor.

* * * * *